US007525048B2

(12) United States Patent
Tufari

(10) Patent No.: US 7,525,048 B2
(45) Date of Patent: Apr. 28, 2009

(54) PROTECTION DEVICE FOR CHAINS OF INSULATORS OF HIGH-VOLTAGE TRANSMISSION LINES

(75) Inventor: Aldo Tufari, Milan (IT)

(73) Assignee: A. Salvi & C. S.p.A., Milan (IT)

( * ) Notice: Subject to any disclaimer, the term of this patent is extended or adjusted under 35 U.S.C. 154(b) by 401 days.

(21) Appl. No.: 11/389,103

(22) Filed: Mar. 27, 2006

(65) Prior Publication Data

US 2007/0221397 A1 Sep. 27, 2007

(51) Int. Cl.
*H01B 17/00* (2006.01)

(52) U.S. Cl. ..... 174/138 F; 174/5 R; 174/138 G; 174/144; 174/154; 174/163 R; 439/367; 337/168

(58) Field of Classification Search ..... 174/5 R, 174/3, 40 R, 45 R, 138 F, 138 G, 144, 135, 174/154, 163 R, 146, 168, 169, 191; 439/367, 439/464; 337/168, 181, 187
See application file for complete search history.

(56) References Cited

U.S. PATENT DOCUMENTS 3,898,372 A * 8/1975 Kalb ..... 174/179
5,834,686 A * 11/1998 Barrett et al. ..... 174/5 R
6,878,883 B1 * 4/2005 Rauckman ..... 174/135
6,943,301 B2 * 9/2005 Lee ..... 174/138 R
7,154,034 B2 * 12/2006 Lynch ..... 174/5 R
7,201,600 B2 * 4/2007 Sokol et al. ..... 439/367
7,297,869 B2 * 11/2007 Hiller et al. ..... 174/40 R

* cited by examiner

*Primary Examiner*—Dhiru R Patel
(74) *Attorney, Agent, or Firm*—Young & Thompson

(57) ABSTRACT

Device for the protection from effects of an electric field, of the metal parts of chains of insulators of already mounted and operational high-voltage transmission lines includes:

a fastening/support plate;

anchoring elements to anchor the plate to the suspension yoke of the conductors of the transmission line, the anchoring elements being adjustably mounted on the plate according to at least two degrees of freedom; and at least one guard ring, which may be anchored on the plate with fastening elements. The plate has an upturned-U cross-section and its upper surface is formed by geometrically coupling with the lower surface of the suspension yoke. The anchoring elements include a pair of arms articulately, mounted on the plate; such articulation including, for each arm, a pin pivotally, mounted within seats formed in the plate perpendicularly to the longitudinal axis thereof, and a pair of holes running through the pin.

20 Claims, 3 Drawing Sheets

PROTECTION DEVICE FOR CHAINS OF INSULATORS OF HIGH-VOLTAGE TRANSMISSION LINES

CROSS REFERENCE TO RELATED APPLICATIONS

None.

STATEMENT REGARDING FEDERALLY SPONSORED RESEARCH OR DEVELOPMENT

None.

THE NAMES OF PARTIES TO A JOINT RESEARCH AGREEMENT

None.

INCORPORATION BY REFERENCE OF MATERIALS SUBMITTED ON A COMPACT DISC

None.

BACKGROUND OF THE INVENTION

1. Field of the Invention

The present invention relates to the field of protection of the chains of insulators of high-voltage transmission lines.

2. Description of the Related Art

In high-voltage transmission lines, normally suspended to chains of insulators and anchored to tall support poles, the phenomenon of flashovers is known, which may arise particularly in critical environmental conditions—between the suspension means associated with the support pole, and hence grounded, and the transmission line conductors.

The corona effect is also known, produced by abnormal increments of the electric field. Such phenomenon is due to high electric loads and manifests itself on the first insulators of the chains, on the line side.

This is also the location where, in bundle lines, the supporting yoke of the conductors is connected to the last insulator by means of a metallic component which, despite its relatively small size, undergoes strong tensile stress.

In order to prevent the above-mentioned phenomena (flashovers and corona effect) from translating into corrosion of the metal parts next to the conductors, the use of so-called "guard rings" to be applied to the bottom of the chain of insulators has long been known. These guard rings have the function of improving the distribution of the electric load on the insulators, i.e. of reducing electrical field irregularities on the first insulators on the line side. As a result, by reducing the occurrence of electrical phenomena, the corrosive action thereof is reduced and any risk of early structural weakening, possibly leading to failure, is prevented.

Guard rings are generally manufactured from a rod or metal tube, bent so as to form a ring surrounding the lower end of the chain of insulators. These guard rings are further equipped with a support allowing the anchoring thereof directly on the spacing yoke. The support is suitably formed, so as to project also towards the insulators of the suspension chain.

It was also possible to ascertain that a guard ring must not necessarily fully surround the lower end of the chain of insulators: a protection projecting on the outer side of the line and of a suitable form, also called "racket", is sufficient. Such protection, formed by a rod or by a tube bent bow-like which does not surround the entire chain of insulators, performs equally well the function of modifying the electric field shape and of moving away the flashover. In any case, whenever reference is made in the present description to a "guard ring", it is intended to refer in general also to any type of suitably formed "racket-like protection".

Although said phenomena (corona effect and flashovers) are well known as being damaging to chains of insulators, some high-voltage transmission lines so far lack guard rings or similar protections. For such plants the problem then arises of how to achieve protection thereof.

It is clear that the currently most readily available solution of this problem is that of detaching the conductors from their respective chain of insulators and of replacing the existing spacing yoke with another one equipped with a guard ring and hence suitably formed to house it. Such a solution, however, is not feasible due to at least 3 reasons:

- in order to be able to replace the existing assembly, the alternative assembly, i.e. spacing yoke and guard ring, cannot be of just any shape: it must be designed so as to interface with the sockets existing on the chain. It is therefore necessary to design and manufacture ad hoc a plurality of alternative assemblies according to the features of the various types of existing chains, with evident significant costs;
- the replacement of the existing spacing yoke with an alternative assembly implies the need, as said, to detach the line conductors from their respective chain, with evident, equally high, operating costs;
- finally, the detachment operation of the conductors from the chain must necessarily be carried out on a de-energised transmission line. This is generally not acceptable due to the resulting discontinuing of the power supply which, considering that this operation must be repeated on multiple poles, is relatively prolonged.

BRIEF DESCRIPTION OF THE INVENTION

It is hence the object of the present invention to suggest a device for the protection of the chains of insulators of high-voltage transmission lines, the manufacturing of which is simple and inexpensive, at the same time being very sturdy, and apt to be quickly and easily installed on existing plants, possibly on a live line also.

This result is achieved thanks to the features mentioned in claim 1.

BRIEF DESCRIPTION OF THE SEVERAL VIEWS OF THE DRAWINGS

Further features and advantages of the invention are in any case more evident from the following detailed description of some preferred embodiments, given purely by way of a non-limiting example and illustrated in the accompanying drawings, wherein.

DETAILED DESCRIPTION OF THE INVENTION

Figure 2:
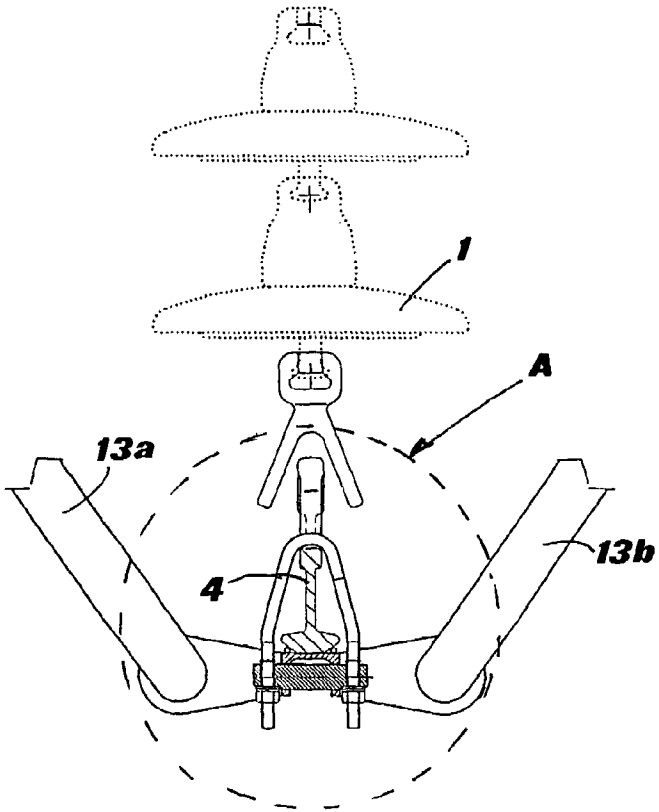
FIG. 2 shows the same arrangement of FIG. 1, in a view at 90° to FIG. 1, with a spacing yoke shown in an axial cross-section.
Figure 1:
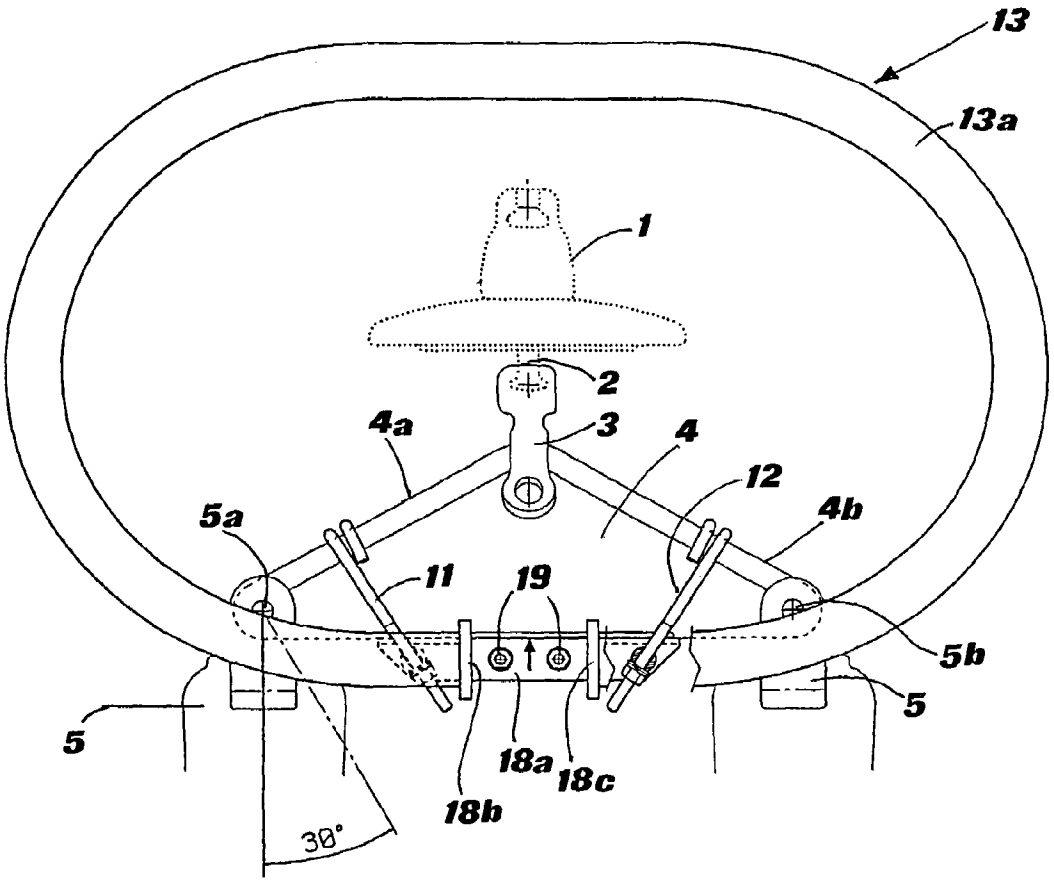
FIG. 1 is an elevation view of a device according to the present invention, applied to a triangular supporting yoke, seen from the front.

In FIGS. 1 and 2 a type of suspension of the conductors of a so-called double high-voltage transmission line is shown which, in a well-known manner, consists of a single vertical chain 1 of insulators, ending at the bottom in a pin 2 for the attachment of an anchoring saddle 3 of a spacing yoke 4; said spacing yoke is generally formed as an isosceles triangle and carries, at the two side ends 4*a* and 4*b*, two clamps 5 supporting the two conductors (not shown) of the transmission line. The anchoring of clamps 5 is accomplished by means of pins 5*a*, 5*b* having their axis parallel to that of the conductors, in order to allow a certain lateral oscillation of said conductors.

It is assumed that this double arrangement is mounted on a series of supporting poles of a transmission line and that such transmission line has already been tested and is fully operational.

The protection device according to the present invention substantially consists of a fastening/support plate 10 (better shown in FIG. 6), of a pair of U-Bolts 11, 12 and of at least one protection 13.

More in detail, plate 10 is formed as an elongated body with an upturned-U section, the upper surface 10*a* of which is formed so as to rest on the lower surface of spacing yoke 4 with a substantially geometric coupling; in actual fact, it may be sufficient to provide two parallel ribs 10*h* projecting by a short length from said upper surface 10*a*, at a short distance form each other. Thereby, plate 10 may be applied with its upper surface 10*a* against the lower surface of spacing yoke 4 with the certainty that, even when this surface of spacing yoke 4 is rounded off (as in the case of the arrangement of FIG. 2), it is housed and securely retained between the two ribs 10*b*.

Anchoring means hold plate 10 in tight contact with the lower surface of spacing yoke 4; such anchoring means in actual fact consist of the above-mentioned U-Bolts 11 and 12. Each of these U-Bolts has the shape of a U-bolt with threaded ends formed by anchoring arms 11*a*, 11*b*, 12*a*, 12*b*.

The ends of these U-bolts are apt to engage with gauged holes which cross diametrically a pair of large-diameter pins 14. More precisely, these pins 14 go through the vertical walls of plate 10, in respective seats wherein they are mounted freely pivoting about horizontal axes, such as being perpendicular to the longitudinal axis of plate 10.

The ends of U-bolts 11, 12 are, as said, threaded; once they have been introduced into said gauged holes, nuts 15 are threaded thereon, each of which abuts with the surface of respective pin 14, with the interposition of a support washer 16 and possibly of an elastic washer 17, for the function better described in the following.

Thanks to this construction, the position of the two U-bolts 11, 12 is. with respect to plate 10 by way of an articulation system having two degrees of freedom; more precisely, they have the option of pivoting, integrally with pin 14, about the axis thereof, and the option of sliding along their longitudinal axis, along the above-mentioned gauged hole in the same pin 14.

The guard-ring protection 13 consists—at least in the two embodiments shown—of a pair of rackets 13*a*, 13*b*. These protections 13*a*, 13*b* are manufactured by suitably bending, in a well-defined manner, a length of rod or tube, bent circle-wise or ellipse-wise, the ends of which are welded to retain and support brackets 18.

Figure 6:
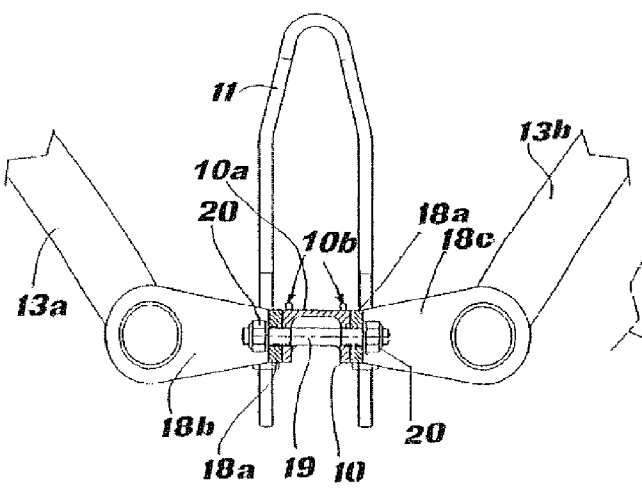
FIG. 6 is an end view, partially in cross-section according to line VI-VI of FIG. 5, of the device according to the invention only.

More precisely, it can be seen from FIGS. 1 and 6 that each of the two brackets, which are found at the two sides of plate 10 and which support protections 13*a* and 13*b*, respectively, is U-shaped, with a bottom part 18*a* and two square-bent arms 18*b*, 18*c*.

For the fastening of rings 13*a*, 13*b* on plate 10, the bottom part 18*a* of each bracket 18 is fastened and tightened against the side wall of plate 10 by means of bolts 19—which run across both side walls of plate 10—and of respective nuts 20. In order to ease mounting and tightening operations, it is possible to manufacture bolts 19 as stud-bolts, fastened, for example welded, to plate 10.

Figure 3:
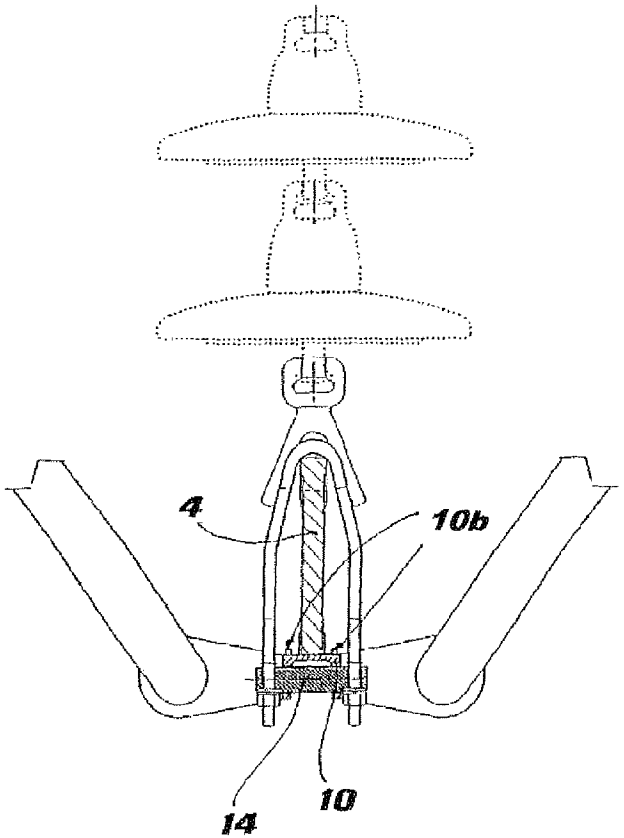
FIG. 3 shows the detail encircled in A in FIG. 2, with a different configuration of the spacing yoke.

When the device assembly like the one just described is to be mounted on a suspension 1 of a chain of insulators, without disassembling any part of said suspension, the operator proceeds as follows:

a)—he brings plate 10 in contact with the lower surface of spacing yoke 4, and retains it in this position. (It can be noticed from FIG. 2 that, when the lower surface of spacing yoke 4 has a rounded off strengthening rib, support is also provided on ribs 10*a*, which ensure correct centering and more precise retaining; instead, when said lower surface of spacing yoke 4 is plane, as shown in FIG. 3, correct support is ensured also without the cooperation of ribs 10*a*);

b)—he brings the two U-bolts 11 and 12, one by one, to fasten to the upper ribs 4*a* and 4*b* of spacing yoke 4, and at the same time introduces the lower threaded ends thereof, each into its respective gauged hole, which pin 14 runs through;

c)—he engages nuts 15 with said threaded lower ends, downwardly coming out of the holes in pin 14 and screws them up until a light tightening is obtained. In this step of light tightening, the operator will take care to orient U-bolts 11, 12 into such a position as to guarantee maximum stability of the assembly under traction. When the two U-bolts 11, 12 are mounted in this manner (with light tightening) and the operator has correctly determined the inclination thereof to spacing yoke 4, it is provided to further screw nuts 15 up to a final tightening;

d)—he finally engages bolts 19 through the respective holes in the walls of plate 10 and mounts, on their opposite threaded ends, brackets 18 supporting the protections, which are definitively fastened by the tightening of nuts 20.

Of course, the device according to the invention can be delivered to the user disassembled into all of its components or pre-assembled in a unitary assembly; in this second case, the assembly, however, will have to be apt to be easily disassembled for the final mounting. As a matter of fact, it is clear that the steps from a) to c), which are relatively more delicate due to the need to achieve a precise positioning of plate 10, can be more easily performed if plate 10 is lightweight, i.e. lacking protections 13; the final step d), consisting in the mounting and fastening of said protections 13, which are remarkably more heavy-weight, is instead performed when plate 10 is stable in its final position.

Figure 4:
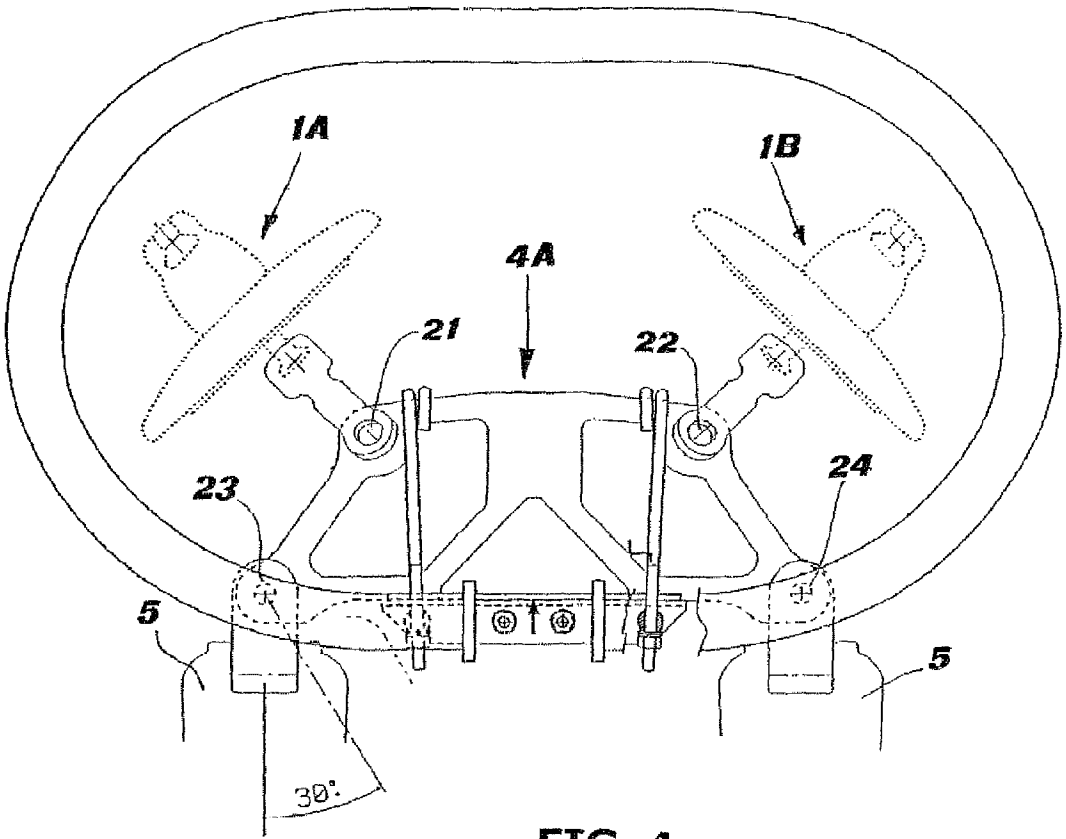
FIG. 4 is a view similar to that of FIG. 1, out with a supporting yoke having a different configuration, intended for a suspension having two inclined chains of insulators, converging in the point of suspension.
Figure 7:
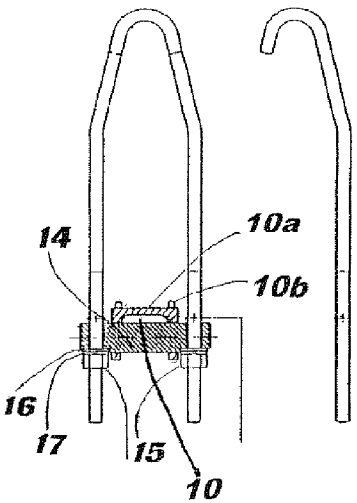
FIG. 7 is a view similar to that of FIG. 6, but referring to a section according to line VII-VII of FIG. 5.
Figure 5:
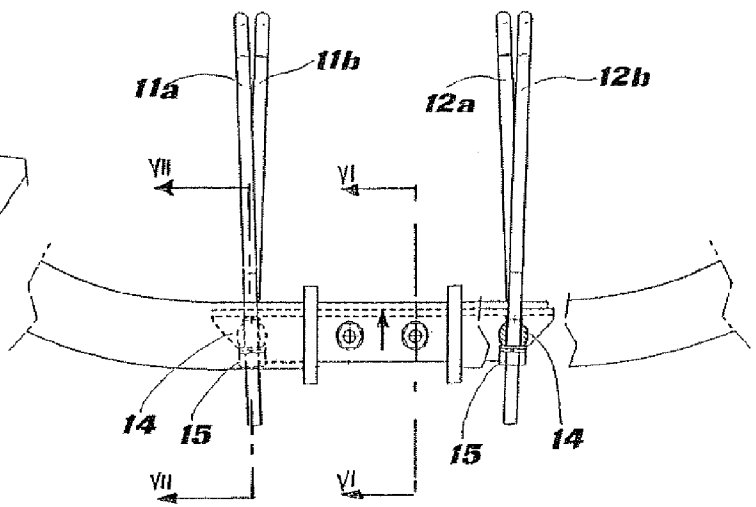
FIG. 5 is an elevation view similar to that of FIG. 1, but referring to the device according to the invention only.

The arrangement illustrated in FIG. 4 shows how the device according to the invention—still consisting of the same, identical group of already-described elements 10 to 13—can be used in case of a suspension of the transmission line having a completely different conformation.

As a matter of fact, in the case shown precisely in FIG. 4, it is a suspension with two chains of insulators 1A and 1B arranged diagonally and converging towards a spacing yoke 4A, which in this case is substantially formed as an isosceles trapezium. The chains 1A, 1B of the insulators are fastened at the two angles 21, 22 of the upper edge of the trapezium spacing yoke, while clamps 5 supporting the conductors are fastened at the two angles 23, 24 of the lower edge of the trapezium spacing yoke.

With such a type of suspension, U-bolts 11, 12 are mounted substantially vertical (as is clearly shown by FIG. 4) since they can be fastened to the essentially horizontal upper edge of the trapezium yoke. As can be easily understood without any particular additional explanations, the operator acts exactly as described in the previous case, by fastening the anchoring arms 11*a*, 11*b*, 12*a*, 12*b* of the U-bolts 11 and 12 one by one and locking them in position; in this arrangement, on the contrary, the manoeuvre is easier than in the arrangement of FIG. 1 because U-bolts 11, 12 can freely rest on the upper horizontal edge of spacing yoke 4 in any position thereof without falling off.

It is intended, however, that the invention must not be considered limited to the device illustrated above, which represents only one of the possible exemplary embodiments, but that different variants are possible, all within the reach of a person skilled in the field. These variants can concern for example the shape of U-bolts 11, 12, each of which might consist of a pair of rods formed as a hook and which may be independently coupled with pin 14, so as to be able to be fastened and secured to ribs 4A and 4B of spacing yoke 4 in different positions, for the purpose of a more precise and secure anchoring. The variants can further concern not only the U-bolts, but also fastening/support plate 10, for example to adapt it to very specific shapes of supporting yokes, for different transmission lines from the double ones illustrated here. These variants, evidently within the reach of a person skilled in the field, will therefore all have to be considered as falling within the scope of protection of the invention, as defined in the following claims.

The invention claimed is:

1. A protection device, of a guard-ring type, for the protection from the effects of the electric field, of the metal parts of chains of insulators of already mounted and operational high-voltage transmission lines, characterised in that it essentially consists of a fastening/support plate (10), anchoring means (11, 12), to anchor said fastening/support plate (10) to a spacing yoke for the suspension of the conductors of the transmission line, said anchoring means (11, 12) being mounted adjustably through said fastening/support plate (10) according to at least two degrees of freedom, and at least one guard ring (13), which may be anchored on said fastening/support plate (10) by way of steady fastening means (18, 19, 20).

2. Protection device as claimed in claim 1), characterised in that said fastening/support plate (10) is in the shape of a length of metal profile with a substantially U-shaped section.

3. Protection device as claimed in claim 2, characterised in that said fastening/support plate (10) has an upturned U section and in that the upper surface thereof (10*a*) is shaped so as to form a substantially geometric coupling with the lower surface of a suspension yoke.

4. Protection device as claimed in claim 1), characterised in that said fastening/support plate (10) has an upturned U section and in that the upper surface thereof (10*a*) is shaped so as to form a substantially geometric coupling with the lower surface of a suspension yoke.

5. Protection device as claimed in claim 4), characterised in that said upper surface (10*a*) is plane and two ribs (10*b*) project upwards therefrom, parallel to the longitudinal axis of said surface and mutually spaced apart.

6. Protection device as claimed in claim 1), characterised in that said anchoring means consist of a pair of anchoring arms (11, 12), mounted articulated on said fastening/support plate (10).

7. Protection device as claimed in claim 6), characterised in that two anchoring arms (11, 12) are mounted on said fastening/support plate (10) adjustable in position by way of an articulation system having two degrees of freedom.

8. Protection device as claimed in claim 7), characterised in that said articulation system comprises, for each of said anchoring arms (11, 12), a pin (14) having a horizontal axis, mounted pivotable in housing holes formed in said fastening/support plate (10) perpendicularly to the longitudinal axis thereof, this rotation representing a first degree of freedom of said articulation.

9. Protection device as claimed in claim 6), characterised in that said articulation system comprises, for each anchoring arm (11, 12), a pin (14) having a horizontal axis, mounted pivotable in housing holes formed in said fastening/support plate (10) perpendicularly to the longitudinal axis thereof, this rotation representing a first degree of freedom of said articulation.

10. Protection device as claimed in claim 9), characterised in that said articulation system further comprises at least a hole which runs through said pin (14) perpendicularly to the axis thereof, each of said two anchoring arms (11, 12) being mounted slideably adjustable within its respective hole, such sliding representing a second degree of freedom of said articulation.

11. Protection device as claimed in claim 10), characterised in that each of said anchoring arms is shaped as a U-bolt.

12. Protection device as claimed in claim 10), characterised in that each of said anchoring arms is shaped as a pair of rods (11*a*, 11*b*; 12*a*, 12*b*), upwardly ending in a hook.

13. Protection device as claimed in claim 9), characterised in that each of said anchoring arms is shaped as a U-bolt.

14. Protection device as claimed in claim 13), characterised in that the lower ends of the U-bolt, or of each of said two rods (11*a*, 11*b*; 12*a*, 12*b*) forming an anchoring arm, respectively, are mounted slidingly adjustable within a pair of said holes drilled in said horizontal pin (14).

15. Protection device as claimed in claim 14), characterised in that said lower ends are threaded and cooperate, for the purpose of the position adjustment, with opposite adjustment and locking nuts (15).

16. Protection device as claimed in claim 9), characterised in that each of said anchoring arms is shaped as a pair of rods (11*a*, 11*b*; 12*a*, 12*b*) upwardly ending in a hook.

17. Protection device as claimed in claim 1), characterised in that said guard ring (13) consists of a pair of diametrically opposite rings (13*a*, 13*b*).

18. Protection device as claimed in claim 17), characterised in that each of the rings (13*a*, 13*b*) of said pair has an open shape and the ends thereof are fastened to retaining and support brackets (18), securely anchored on opposite sides of said fastening/support plate (10).

19. Protection device as claimed in claim 18), characterised in that each of the two brackets (18) is U-shaped, with a bottom part (18*a*) and two square-bent arms (18*b*, 18*c*), the two ends of each guard ring (13*a*, 13*b*) being fastened on the two arms (18*b*, 18*c*) of a single bracket.

20. Protection device as claimed in claim 17), characterised in that the assembly consisting of guard ring (13) and retaining and support bracket (18) makes up a pre-mounted assembly, apt to be secured to said fastening/support plate (10) by way of anchoring means consisting of a stud-bolt (19) and a nut (20).

* * * * *